US005878580A

United States Patent [19]

Schilling et al.

[11] Patent Number: 5,878,580

[45] Date of Patent: Mar. 9, 1999

[54] METHOD OF OPERATING A CRYOGENIC COOLING DEVICE, AND A CRYOGENIC COOLING DEVICE SUITABLE FOR OPERATION BY THIS METHOD

[75] Inventors: Ernst Schilling, Bonn; Dieter Sous, Erftstadt; Axel Veit, Pulheim; Markus Jung, Köln, all of Germany

[73] Assignee: Leybold Aktiengesellschaft, Germany

[21] Appl. No.: 954,977

[22] Filed: Oct. 20, 1997

Related U.S. Application Data

[63] Continuation of Ser. No. 557,053, Dec. 1, 1995, abandoned.

[30] Foreign Application Priority Data

Jun. 3, 1993 [DE] Germany ..... 43 18 406.5

[51] Int. Cl.[6] ..... F25B 9/00

[52] U.S. Cl. ..... 62/6; 62/467

[58] Field of Search ..... 62/6, 467

[56] References Cited

U.S. PATENT DOCUMENTS

| | | | |
|---|---|---|---|
| 3,119,237 | 1/1964 | Gifford . | |
| 3,188,821 | 6/1965 | Chellis . | |
| 3,620,029 | 11/1971 | Longsworth | 62/6 |
| 4,430,863 | 2/1984 | Longsworth | 62/6 |
| 4,528,818 | 7/1985 | Baker . | |
| 4,543,793 | 10/1985 | Chellis et al. . | |
| 4,622,823 | 11/1986 | Ishizawa et al. | 62/6 |
| 4,761,963 | 8/1988 | Kiese | 62/6 X |
| 4,792,346 | 12/1988 | Sarcia . | |
| 4,987,743 | 1/1991 | Lobb | 62/6 |

FOREIGN PATENT DOCUMENTS

| | | |
|---|---|---|
| 0350290 | of 1990 | European Pat. Off. . |
| 1501049 | of 1969 | Germany . |
| 2051203 | of 1971 | Germany . |
| 3836884 | of 1988 | Germany . |

*Primary Examiner*—Christopher B. Kilner
*Attorney, Agent, or Firm*—Wall Marjama Bilinski & Burr

[57] ABSTRACT

This invention concerns a method of operating a cryogenic cooling device (1) with a cylinder (4, 5) in which a piston (6, 7) reciprocates and with a gas drive (8, 9) which produces the motion of the piston. In order to reduce the vibrations which occur during operation, the invention proposes that the gas drive (8, 9) is controlled in such a way that the piston (6, 7) is only accelerated for part of the stroke.

18 Claims, 3 Drawing Sheets

METHOD OF OPERATING A CRYOGENIC COOLING DEVICE, AND A CRYOGENIC COOLING DEVICE SUITABLE FOR OPERATION BY THIS METHOD

This application is a continuation of application Ser. No. 08/557,053 filed Feb. 26, 1996, now abandoned, which is a 371 of PCT/EP94/01012 filed Mar. 31, 1994.

BACKGROUND OF THE INVENTION

Cryogenic cooling devices[1]) are low-temperature cooling machines in which a thermodynamic cyclic process is running. A single-stage refrigerator comprises a working space in which a displacer reciprocates between two dead centres OT and UT. Related to the displacer is a regenerator through which a working gas also reciprocates corresponding to the motion of the displacer. During the reciprocating motion of the displacer, heat is continually withdrawn from the housing of the refrigerator in the area of one of the two dead centres. With a single-stage refrigerator of this kind it is possible to generate temperatures down to about 30 K. Often refrigerators are of a dual-stage design (refer to DE-A-38 36 884, for example). With dual-stage or three-stage refrigerators it is possible to generate temperatures down to below 10 K. In the refrigerator according to the mentioned document, a gas drive is employed to produce the reciprocating motion of the displacer. For this, a cylinder and piston arrangement is related to the warm side of the displacer whereby said arrangement must be supplied with a driving gas.

[1]) Translator's note: The term „refrigerator" is also used for these cryogenic cooling devices. The term „refrigerator" will be used in this sense in this translation.

Refrigerators of the kind affected here must be equipped with additional control facilities, through which the supply of the working gas into the working cylinder and also the supply for the gas drive is controlled. It is common to employ helium both as the working gas and the driving gas. In designs of this kind, it is sufficient to equip the refrigerator with two connections, one of which is supplied with high pressure helium (20 bar, for example) and where the other is supplied with low pressure helium (5 bar, for example).

During the motion of the displacer, forces occur which are greatest at the dead centres. These forces are transferred to the housing of the refrigerator and thus also to any connected devices. Generally, such devices will be highly sensitive measuring instruments (nuclear magnetic resonance tomographs, electron beam microscopes, for example), the measurement results of which are adversely influenced by the occurring vibrations. In the past, several proposals have been made to dampen these interfering vibrations. From the European Patent 19 426 it is known to arrange a damping arrangement between a refrigerator and an electron beam microscope, but this arrangement is relatively involved. From European Patent Application 160 808 it is known to arrange a flat spring within the working space of a refrigerator. Said flat spring takes up a certain amount of space within the working space so that the efficiency of the refrigerating machine is reduced. In DE-A-38 36 884 it is proposed to separate, in time, the cooling process from the measurement process. This solution requires complex control arrangements and reduces the time available to the measurements.

SUMMARY OF THE INVENTION

It is the task of the present invention to operate a refrigerator with a gas drive in such a way that an effective reduction of the vibrations can be attained through relatively simple means.

According to the present invention, this task is solved by the measures of the patent claims. The present invention relies on the finding that the gas drive in known refrigerators is effective during the entire time of each of the motional phases of the displacer, meaning that the displacer is subjected to a considerable acceleration during the entire time of its motional phases. At the dead centres this leads to relatively strong impacts which are responsible for the vibrations. However, if the displacer is—in line with the present invention—only accelerated at times or only at the beginning of its motional phases, then the final velocities at the dead centres will be lower and the impacts at the housing less hard. By controlling the quantity of gas through which the gas drive is supplied for both motional directions it is possible to control the amount of drive energy and thus attain the desired goal. Through the measures according to the present invention it is possible to reduce the occurring vibrations by a factor of 4 or more, without significantly impairing the efficiency of the refrigerator.

DESCRIPTION OF THE INVENTION

Further advantages and details of the present invention shall be explained by referring to the design examples presented in drawing FIGS. 1 to 5.

Figure 1:
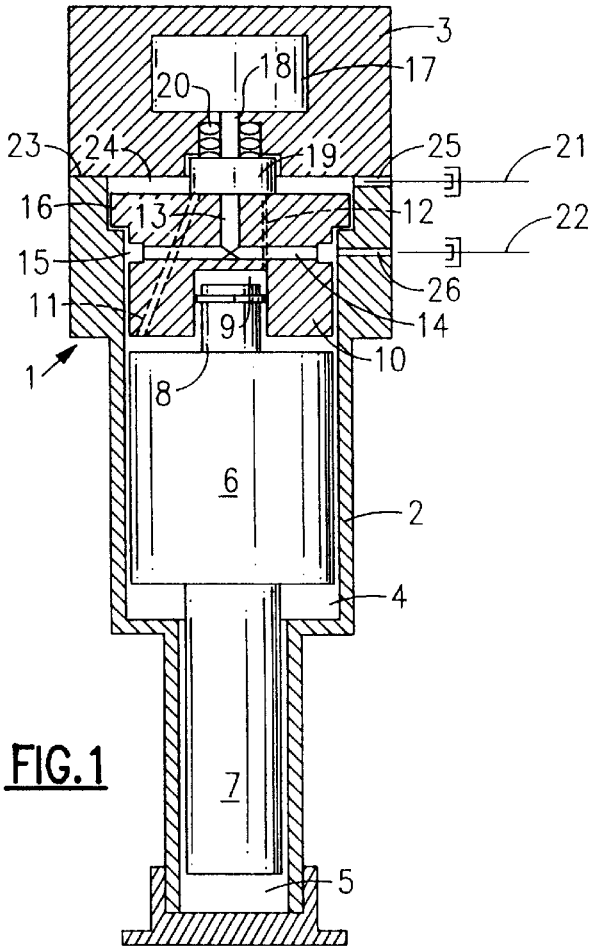
FIG. 1 is a cross-section schematic of a refrigerator of a type which the present invention is applicable.

The dual-stage refrigerator 1 presented in the drawing figure has a housing which consists of the two parts 2 and 3. The cylindrical working spaces 4 and 5 for the two displacer stages 6 and 7 are housed in housing part 2.

The upper displacer stage 6 is equipped, on its warm side, with a drive piston 8, the corresponding cylinder 9 of which is located in a guide bush 10 which terminates the working space 4 against housing part 3. The guide bush 10 is equipped with bore holes 11, 12 and 13. Bore hole 11 opens into working space 4 and serves the purpose of supplying this space with the working gas. Bore hole 13 opens into a cross hole 14 which is connected by a circular groove 15 to the outside wall of guide bush 10. Bore hole 12 is indicated by a dash-dot line and serves the purpose of supplying the drive cylinder 9 with the driving gas. The various bore holes are located in different planes so that they do not cross each other, this being indicated by the dashed or dash-dot lines. They all open into the upper side of the guide bush 10 which in this area is designed as a fixed valve disc 16.

Housed in housing part 3 is a motor 17 which actuates a rotating valve disc 19 via the shaft 18. The fixed valve disc 16 and the rotating valve disc 19 which is under the influence of pressure spring 20, form a control valve which serves the purpose of supplying, in a basically known manner, the bore holes with high pressure and low pressure gas. In the design example presented, working gas and driving gas are identical. Preferably helium is employed.

The connections for the high pressure and the low pressure gas are marked 21 and 22 respectively. The separating plane 23 between the housing parts 2 and 3 is located at the level of the control valve 16, 19. It is selected in such a way that after removal of the upper housing part 3 with motor 17 and rotating valve disc 19, a flat pot-shaped space 24 is present above the fixed valve disc 16. At the level of this space 24, a bore hole 25 is provided which penetrates the wall of housing part 2 whereby said bore hole connects space 24 with the high pressure connection 21. The low pressure connection 22 is connected to the bore hole 26 in housing part 2[2]) which opens at the level of the circular groove 15 of guide bush 10.

[2]) Translator's note: The German text reads „3" here where „2" would be appropriate and in line with the drawings. The latter has been assumed for the translation.

During operation of the presented refrigerator, the working gas which is at high pressure flows via connection 21 into chamber 24. From there the various bore holes are supplied with the aid of control valve 16, 19. After its expansion in refrigerator stages 4, 5 the working gas enters bore holes 13, 14 and flows out via circular groove 15 and the low pressure connection 22. The pressure of the working gas which is applied to the high pressure connection 21 is commonly about 20 to 22 bar, whereas the pressure of the working gas at the low pressure connection 22 amounts to about 5 to 7 bar.

The speed of the motor 17 and the design of the facing sides of fixed (16) and rotating (19) valve disc are decisive for the gas supply to working space 4 and drive cylinder 9. From DE-A-38 36 884 a design for the control valve is known, where a relatively wide outer recess in the rotating valve disc also supplies, at times, the openings of two bore holes which also have a relatively large diameter with high pressure gas. One of these two bore holes serves the drive cylinder. Due to the selected dimensions, the displacer is accelerated during its entire motional phase from the warm to the cold side of the working space. This equally applies to the motional phase of the displacer from the cold to the warm side of the working space, since the oblong recess which at times connects the openings of the two supply bore holes to the low pressure gas connection, has similarly large dimensions.

Figure 2:
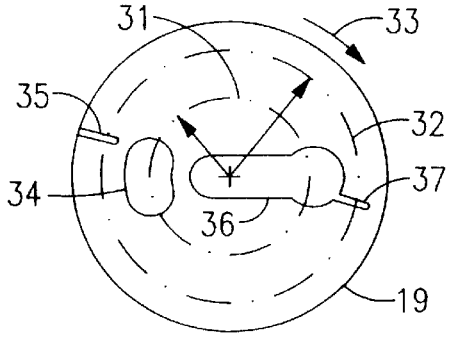
FIG. 2 is a cross-section of an embodiment of a rotating disc of a disc valve in accordance with the invention.
Figure 3:
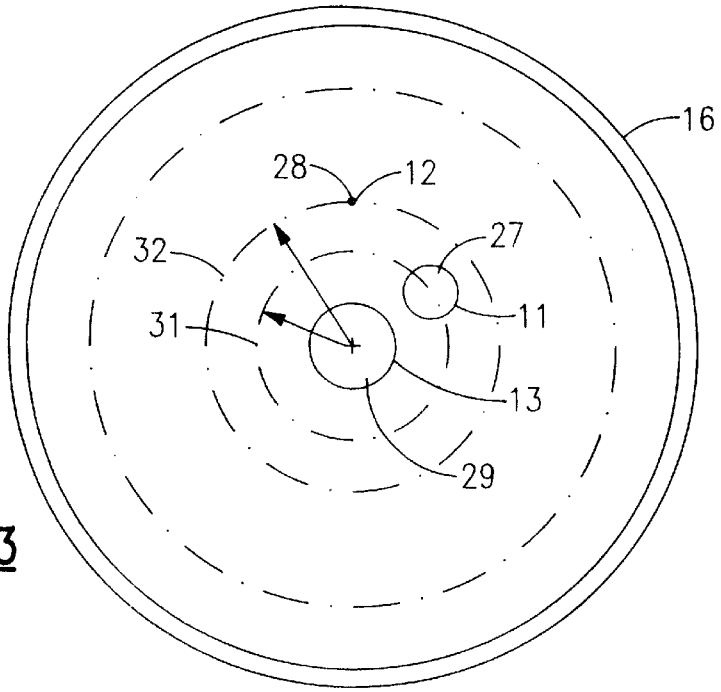
FIG. 3 is a cross-section of an embodiment fixed disc of a disc valve in accordance with the invention.

Drawing FIGS. 2 and 3 show designs for the valve disc 16 and 19, through which the gas can be controlled as desired in the sense of the present invention. The fixed valve disc 16, the top view of which is shown (drawing FIG. 3), permits a view of the openings 27, 28, 29 of the bore holes 11, 12 or 13. As in the case of a state of the art design, the bore hole 13 and its opening 29 are located in the centre whereas the radial distance of the openings 27, 28 of bore holes 11 or 12 is—opposed to the state of the art—no longer the same with respect to the rotational axis of valve disc 19 (circles 31, 32). Moreover, opening 28 of bore hole 12 has a significantly smaller diameter compared to the opening 27 of bore hole 11.

The rotating valve disc 19, the design of which is shown in drawing FIG. 2 in a ghosted view through valve disc 19, rotates corresponding to the direction of arrow 33 on the fixed valve disc 16. A bore hole 34 having a relatively wide cross section which connects to high pressure space 24 and which penetrates valve disc 19 is related to circle 31. The recess 35 related to circle 32 is designed as a relatively narrow slot. Moreover, valve disc 19 is equipped with a relatively large recess 36 which extends from the centre to circle 31. Slot-like recess 37 extends from this recess 36 to circle 32.

During the rotation of the valve disc 19, the control openings 34 to 37 of valve disc 19 and the control openings 27 to 29 of valve disc 16 pass over against each other. At first slot 35 on circle 32 reaches the opening 28 of bore hole 12. Because of this, the drive cylinder 9 is linked for a relatively short time to space 24 which is at high pressure and the displacer 6 is accelerated in the direction of the cold side of the working space. Thereafter, bore hole 34 on circle 31 of the rotating valve disc reaches the opening 27 of bore hole 11 in the fixed valve disc 16. For the—relatively long—period of time during which these openings 34 and 27 pass over against each other, the working space 4[3]) is supplied with high pressure gas. Next, the slot 37 on circle 32 reaches the opening 28 of bore hole 12 so that the drive cylinder 9 is linked for a short period of time to the bore hole 13 which is at low pressure. The displacer 6 thus moves to its warm side. Finally, the recess 36 reaches the opening 27 of bore hole 11 on circle 31 so that the gas in the working space 4[4]) is expanded to a low pressure. Thereafter the cycle repeats itself.

[3]) Translator's note: The German text reads „14" instead of „4" which would be in line with the drawings and the remaining text. „4" has been assumed for this translation.

[4]) Translator's note: The German text reads „14" instead of „4" which would be in line with the drawings and the remaining text. „4" has been assumed for this translation.

Figure 4:
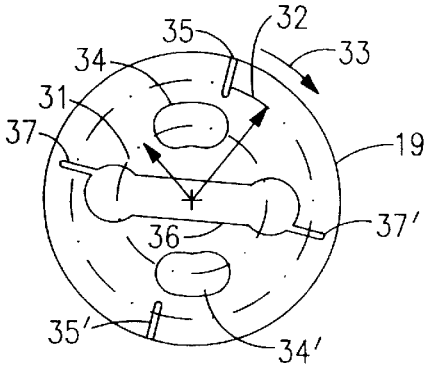
FIG. 4 is a cross-section of another embodiment of a rotating disc of a disc valve in accordance with the invention.
Figure 5:
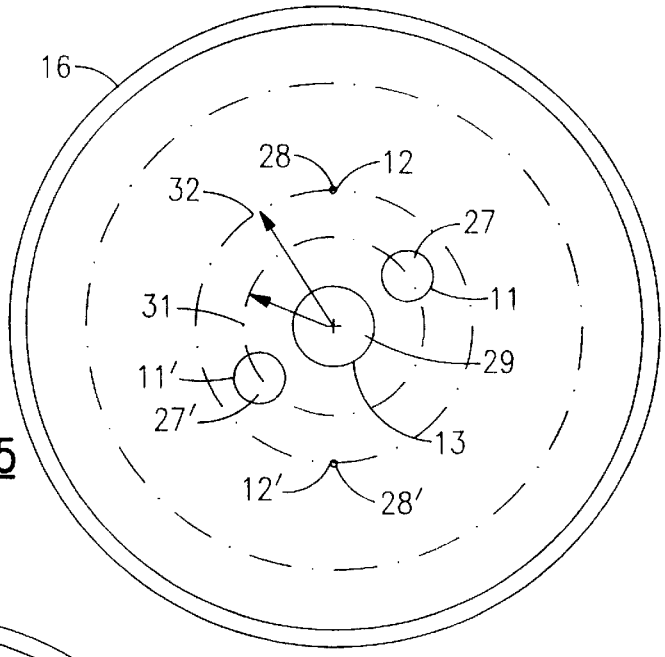
FIG. 5 is a cross-section of another embodiment fixed disc of a disc valve in accordance with the invention.

Drawing FIGS. 4 and 5 show a design example where in the valve discs 16, 19 two each bore holes 11, 11', 12, 12' and 34, 34' which are each offset by 180° and their corresponding openings, are provided. The oblong recess 36 extends on both sides of the centre up to circle 31. Two slots 37, 37' which extend up to circle 32 are present. In this design, the displacer 6 performs twice the number of strokes per turn of valve disc 19.

In the presented and described design example, the openings 27, 28 (27', 28') of bore holes 11 (11')[5]) and 12 (12') in the fixed valve disc 16[6]) are located on circles 31, 32 of different radii. Also the bore holes 34 (34') and recesses 35 (35'), 36 (36')[7]), 37 (37') in the rotating valve disc 19 are located on circles of correspondingly different radii. Thus there exists the possibility of being able to set up large differences with respect to the pass over periods. The supply bore holes for the working space 4[8]) which must be supplied with high pressure or low pressure for a relatively long periods of time open on circle 31 having the smaller diameter. The supply bore holes for the gas drive open on circle 32 with the larger diameter. Short pass over periods are not attained through smaller bore holes or recesses but instead through the higher circumferential velocity.

[5]) Translator's note: The German text reads . . . 11 (11'9 . . . where it should read . . . 11(11'). . . . The latter has been assumed for the translation.

[6]) Translator's note: The German text reads fixed valve disc „17" instead of „16" which would be in line with the drawings and the remaining text. „16" has been assumed for this translation.

[7]) Translator's note: Number 36' does not exist in the drawings.

[8]) Translator's note: The German text reads „14" instead of „4" which would be in line with the drawings and the remaining text. „4" has been assumed for this translation.

The pass over periods for the gas drive which depend on the speed of the rotating valve disc 19, the position and design of the openings 27 to 29, recesses 35 to 37 as well as bore hole 34, are preferably selected as follows: To effect the motion of displacer 6 towards its cold side, drive cylinder 9 is only linked to the high pressure connection 21 during the first fraction of the time of its entire motion. This fraction is selected—preferably empirically—so that the vibrations caused by the arrival of the displacer at the stops in the housing are considerably reduced and so that the efficiency of the refrigerator is not yet significantly impaired. The order of magnitude of this fraction amounts to about one third of the entire motional period. To effect the motion of displacer 6 in the reverse direction, the pass over time must be selected so short that the link between the drive cylinder 9 and the low pressure connection 22 has already been closed before the displacer attains its dead centre. Due to the further movement of the drive piston, the gas which is still present in the drive cylinder is compressed so that a damping effect (gas cushion) is attained. The pressure increase of the remaining gas is preferably selected in such a manner that a pressure is attained just before the dead centre is reached, which is somewhat higher than the high pressure level.

Figure 6:
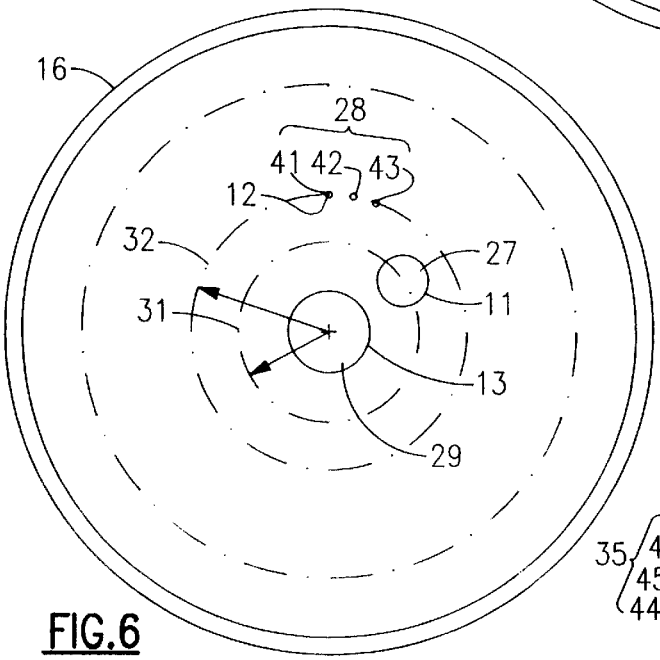
FIG. 6 is a cross-section of another embodiment of a fixed disc of a disc valve in accordance with the invention.
Figure 7:
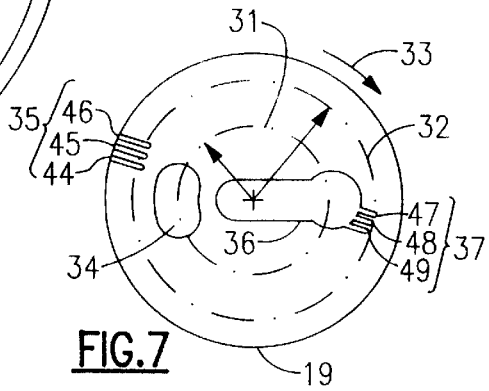
FIG. 7 is a cross-section of another embodiment rotating disc of a disc valve in accordance with the invention.

Drawing FIGS. 6 and 7 show design examples of the fixed and rotating valve discs through which an acceleration of displacer 6, 7 is effected several times and for short periods. For this, either the bore hole 28 of the fixed valve disc 16 is (for example) divided into three bore holes 41, 42, 43 or the recesses 35, 37 in the rotating valve disc 19 have been divided into (for example) three recesses 44 to 46 and 47 to 49, respectively.

Figure 8:
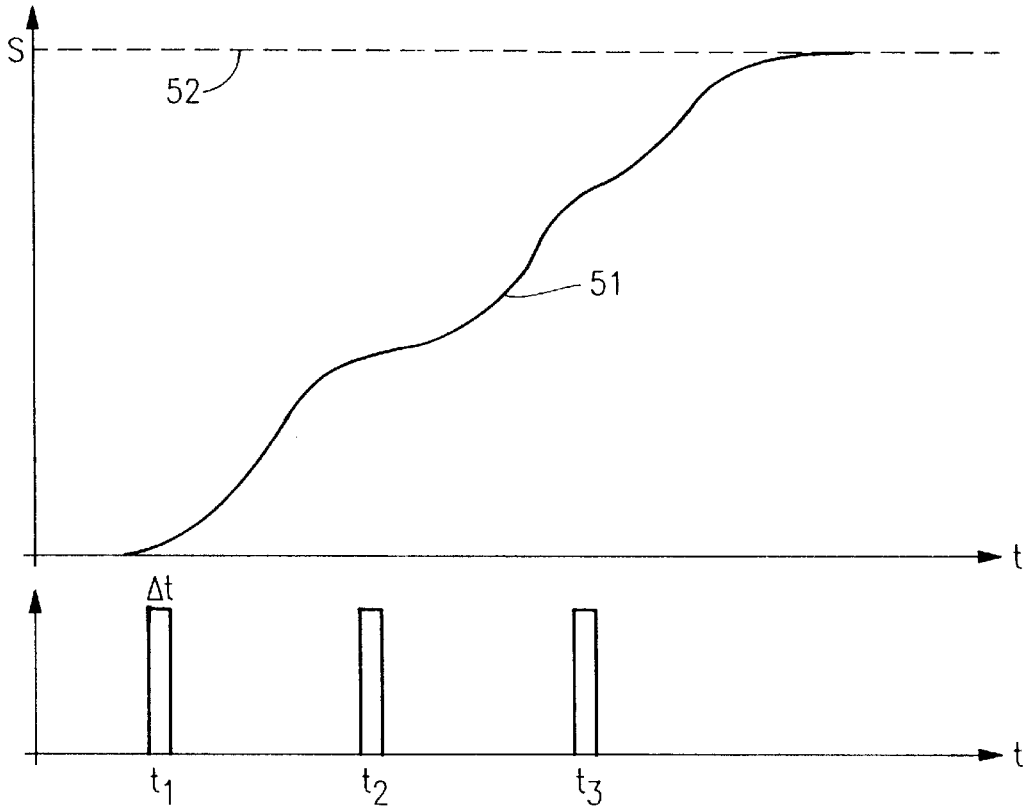
FIG. 8 is a warm-to-cold side motion diagram illustration motional characteristics of an embodiment of the invention.
Figure 9:
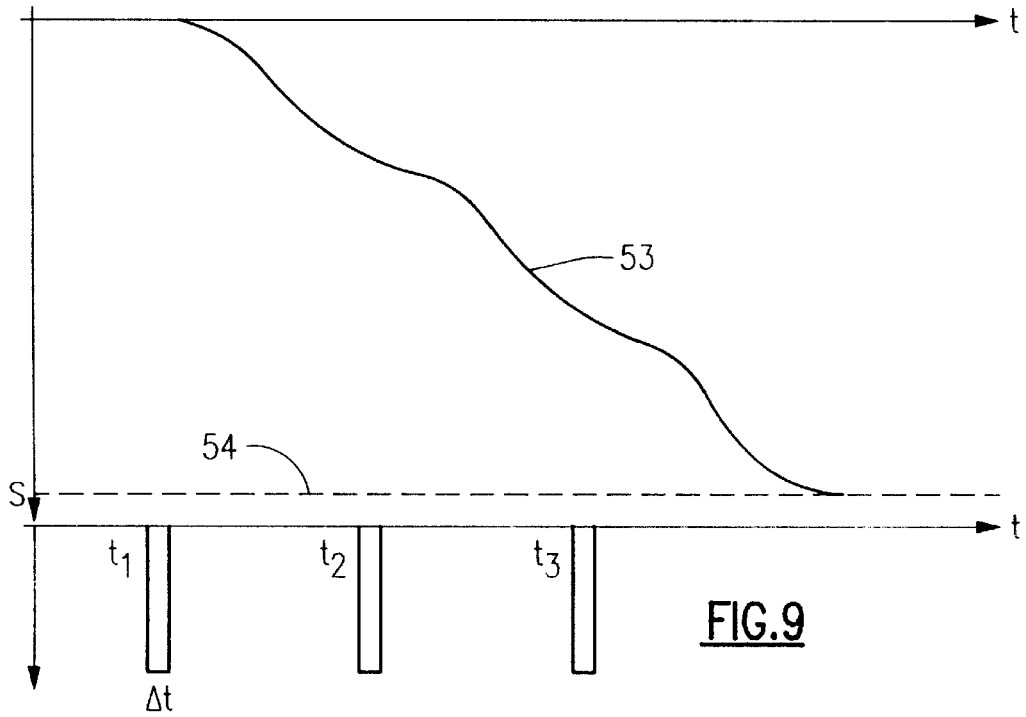
FIG. 9 is a cold-to-warm side motion diagram illustrating motional characteristics of an embodiment of the invention.

Drawing FIGS. 8 and 9 show the effect of these measures. In each of the upper system of coordinates the path s of the displacer has been drawn vs. the time t. Each of the lower system of coordinates shows the points of time $t_1$, $t_2$ and $t_3$ at which the high pressure (drawing FIG. 8) or the low pressure (drawing FIG. 9) is applied to the working cylinder 9.

Drawing FIG. 8 shows the motion of the displacer from the warm to the cold side. At points of time $t_1$, $t_2$ and $t_3$ high pressure gas is applied to the drive cylinder for the time t in each case (5% of the time for the entire motion, for example). Thus the displacer is subjected to three brief thrusts which let it move to the cold side in such a manner that the accelerating and decelerating motions alternate (motion curve 51[9]). The impact of the displacer 6, 7 at housing 2 (dashed line 52[10]) which substantially causes the vibrations, is relatively small. The motion of the displacer 6, 7 from the cold to the warm side runs correspondingly (refer to motion curve 53[11]) in drawing FIG. 9 with stop line 54[12]). The periods of time t are selected in such a manner that in each case a damping gas cushion is generated.

[9] Translator's note: This number does not appear in the drawing figures which accompany the German text. A drawing where this number has been included is provided with this translation.

[10] Translator's note: This number does not appear in the drawing figures which accompany the German text. A drawing where this number has been included is provided with this translation.

[11] Translator's note: This number does not appear in the drawing figures which accompany the German text. A drawing where this number has been included is provided with this translation.

[12] Translator's note: This number does not appear in the drawing figures which accompany the German text. A drawing where this number has been included is provided with this translation.

The designs according to drawing FIGS. 6 to 9 permit the control of the motion sequence of displacer 6, 7 with the aid of short pressure bursts. In comparison to steadily accelerated displacers, the displacer 6, 7 which moves according to the present invention does reach its dead centre at a later point of time; any significant reduction in the efficiency of the refrigerator does, however, not result.

We claim:

1. A method for operating a refrigerator, said refrigerator having a displacer, a cool side, a warm side, a cool side dead center, a warm side dead center, a working space, a drive cylinder, a first motional phase of said displacer from said warm side dead center to said cool side dead center, and a second motional phase of said displacer from said cool side dead center to said warm side dead center, said method comprising the steps of:

applying a high pressure gas during a minor portion of said first motional phase to said drive cylinder to accelerate said displacer toward said cool side; and supplying high pressure gas to said working space.

2. The method of claim 1, further comprising the step, after said supplying step, of providing a low pressure gas during a minor portion of said first motional phase to said drive cylinder before said displacer reaches said cool side dead center so that a gas cushion is created in said working space.

3. The method of claim 1, further comprising the steps, after said supplying step, of:

providing a low pressure gas during a minor portion of said second motional phase to said drive cylinder before said displacer reaches said cool side dead center so that a gas cushion is created in said work space and said displacer is accelerated toward said warm side; and inputting low pressure gas to said working space.

4. A method for operating a refrigerator, said refrigerator having a displacer, a cool side, a warm side, a cool side dead center, a warm side dead center, a working space, a drive cylinder, a first motional phase of said displacer from said warm side dead center to said cool side dead center, and a second motional phase of said displacer from said cool side dead center to said warm side dead center, said method comprising the step of intermittently applying a gas for a plurality of periods of time to said drive cylinder to move said displacer from one to another of said sides so that movement of said displacer is characterized by alternating accelerating and decelerating motions, wherein each period of time for said first motional phase is only a minor portion of the time required of said first motional phase, and wherein each period of time for said second motional phase is only a minor portion of the time required for said second motional phase.

5. The method of claim 4, wherein said gas is a high pressure gas supplied to move said displacer from said warm side to said cool side.

6. The method of claim 4, wherein said gas is a low pressure gas supplied to move said displacer from said cool side to said warm side.

7. A refrigerator comprising:

a housing having a cool side and a warm side;

a displacer disposed in said housing;

a drive cylinder partially defined by said housing and said displacer;

a warm dead center of said displacer;

a cool dead center of said displacer;

a first motional phase of said displacer from said warm side dead center to said cold side dead center;

a second motional phase of said displacer from said cold side dead center to said warm side dead center;

a low pressure gas source for providing low pressure gas;

a high pressure gas source for providing high pressure gas;

a working space defined by said displacer and said housing; and a valve disc valve comprising a fixed disc section partially defining said drive cylinder, said fixed disc section having a first bore hole opening toward said drive cylinder and a second bore hole opening toward said working space; and a rotating disc section adapted to rotate about said fixed disc section for establishing fluid communication between one of said gas sources and one of said bore holes, wherein fluid communication is established between said drive cylinder and said high pressure gas source at the beginning of said first motional phase, and establish with said low pressure gas source at the beginning of said second motional phase, said first bore hole being sized so that said high pressure gas is supplied to said drive cylinder when said first bore passes through a position in fluid communication with said high pressure gas source, wherein said communication occurs only during a minor portion of said first motional phase, and said low pressure gas is supplied to said drive cylinder when said first bore passes through a position in fluid communication with said low pressure gas source, where said communication occurs only during a small portion of said second motional phase.

8. The refrigerator of claim 7, wherein said first bore hole is sized smaller than said second bore hole.

9. The refrigerator of claim 7, wherein said first hole is formed at a wider diameter on said disc than said second bore hole so that said rotating disc has a higher circumferential velocity in relation to said first hole than said second hole.

10. The refrigerator of claim 7, wherein said rotating disc includes formations formed therein so that said first channel is intermittently in fluid communication with one of said gas sources for a plurality of time periods, wherein each time period is one of a minor portion of the time required for said first motional phase for communication with said high pressure gas, and a minor portion of said second motional phase for communication with said low pressure gas, whereby said displacer is moved from one to another of said sides by intermittently supplying gas during said time periods to said drive cylinder.

11. The refrigerator of claim 7, wherein said rotating disc includes a plurality of formations formed complementary with said first and second bore holes so that, when said rotating disc is rotated, said disc valve passes from a first position wherein said first hole is in fluid communication with said high pressure gas source to supply said drive cylinder with high pressure gas for a time period that is a minor portion of the time required for said first motional phase, to a second position wherein said second bore hole is in fluid communication with said high pressure gas source so that high pressure gas is supplied to said working space.

12. A cryogenic cooling device having a working space, a displacer that moves back and forth between a warm side and a cold side, said movement from said warm side to said cold side and from said cold side to said warm side each defining a displacer motion phase, two consecutive displacer motion phases defining a strike, and a gas drive that effects said displacer movement, comprising:

a drive piston coupled with said displacer warm side;

a drive cylinder supplied alternatingly with a high-pressure gas and a low-pressure gas;

gas control device means for connecting intermittently a high pressure gas connection and a low pressure gas connection to said drive cylinder; said gas control device comprising a gas control valve, said gas control valve comprising a stationary valve disc, a rotating valve disc having a center of rotation, a surface of said stationary valve disc facing a surface of said rotary valve, control openings that include at least one opening to said high pressure gas connection and at least one opening to said low pressure gas connection on a facing surface of one of said discs, at least one opening connected to said working space and at least one opening connected to said drive cylinder on the facing surface of the other of said discs, each with a selected position and size on said surfaces; wherein the number of rotations of said rotating valve disk, each selected control opening position, and each selected control opening size is such that each working space opening includes at least a first portion that is an identical radial distance from said center of rotation as at least a portion of one of said high pressure gas connection openings and at least a portion of one of said low pressure gas connection openings and is such that each drive cylinder opening includes at least a second portion that is an identical radial distance from said center of rotation as at least a portion of one of said high pressure gas connection openings and at least a portion of one of said low pressure gas connection openings, wherein said gas drive for effecting said displacer movement from said warm side to said cold side, comprises intermittently establishing a high-pressure gas connection to said drive cylinder at the start of said displacer motion phase with said gas control device means, and said gas drive for effecting said displacer movement from said cold side to said warm side, comprises establishing a low-pressure gas connection to said drive cylinder at the start of said displacer motion phase with said gas control device means for a minor portion of said displacer motion phase generating in the drive cylinder a gas cushion that dampens the displacer movement.

13. The cryogenic cooling device of claim 12, wherein each working space opening first portion has a radial interval from the center of rotation differing from each drive cylinder opening second portion.

14. The cryogenic cooling device of claim 13, wherein said radial intervals of said drive cylinder opening first portion from the center of rotation is greater than said radial intervals of said working space opening second portion.

15. The cryogenic cooling device of claim 12 wherein each drive cylinder opening first portion size is smaller than each working space opening second portion size.

16. The cryogenic cooling device of claim 12 wherein said gas control valve includes a plurality of drive cylinder openings.

17. The cryogenic cooling device of claim 12 wherein each drive cylinder opening includes at least a second portion that is an identical radial distance from said center of rotation as at least a portion of a plurality of said high pressure gas connection openings and at least a portion of a plurality of said low pressure gas connection openings.

18. The cryogenic cooling device of claim 12 wherein said control openings are presented at least twice, whereby said displacer executes at least two or more strokes during one rotation of said rotating valve disc.

* * * * *